United States Patent [19]

Morival et al.

[11] Patent Number: 4,512,533

[45] Date of Patent: Apr. 23, 1985

[54] PROCESS AND APPARATUS FOR UNWINDING COILS OF WIRE

[76] Inventors: Fernand Morival, 51, route de Tournai, 59226 Lecelles; Anne Morival, 11, rue Jean Jaures, 59178 Hasnon, both of France

[21] Appl. No.: 596,553

[22] Filed: Apr. 4, 1984

Related U.S. Application Data

[63] Continuation-in-part of Ser. No. 451,950, Dec. 21, 1982.

[30] Foreign Application Priority Data

Apr. 13, 1983 [FR] France ..... 83 06328

[51] Int. Cl.[3] ..... B65H 49/00

[52] U.S. Cl. ..... 242/129; 242/129.8

[58] Field of Search ..... 242/54 R, 78.6, 128, 242/129, 129.5, 129.8; 206/391, 393, 398, 400

[56] References Cited

U.S. PATENT DOCUMENTS

| | | | |
|---|---|---|---|
| 2,858,088 | 10/1958 | Bookout | 242/128 |
| 2,930,541 | 3/1960 | Crum | 242/128 |
| 2,950,876 | 8/1960 | McLoughlin | 242/128 |
| 3,028,117 | 4/1962 | Shepley | 242/129 |
| 3,125,312 | 3/1964 | McDuffie | 242/129 |
| 3,512,635 | 5/1970 | Lang | 206/52 |
| 3,868,070 | 2/1975 | Goodzey et al. | 242/129 |

FOREIGN PATENT DOCUMENTS

| | | |
|---|---|---|
| 29971 | 6/1981 | European Pat. Off. . |
| 901363 | 1/1954 | Fed. Rep. of Germany . |
| 1146262 | 11/1957 | France . |
| 2182594 | 12/1973 | France . |
| 2306922 | 11/1976 | France . |
| 729738 | 5/1955 | United Kingdom . |
| 734718 | 8/1955 | United Kingdom . |

*Primary Examiner*—Leonard D. Christian

*Attorney, Agent, or Firm*—Harding, Earley, Follmer & Frailey

[57] ABSTRACT

Process and apparatus for unwinding hollow coils of wire quickly and reliably without mishaps such as jammed turns, the formation of knots or blockages, wire breakage and the like. The coils are positioned with their axes vertical and then are gripped externally by a corset element to retain the coils stationary during unwinding. Wire is withdrawn upwardly from the hollow of the coil and slides over a pressure device en route to a fixed eyelet and a rotatable drum disposed above the coil. The pressure device exerts pressure on the top of the coil to stabilize the coil during unwinding, and increases slightly the curvature of the unwinding turns of wire to facilitate withdrawal. Actuator devices are provided for opening and closing the corset element and for raising and lowering the pressure device. Two or more apparatuses may be provided for continuous unwinding. In such a plural arrangement, a wire connector between adjacent apparatuses joins the end of one coil to the beginning of the next coil, by welding or the like, whereby unwinding of wire can be carried out without stoppage upon depletion of a coil.

21 Claims, 24 Drawing Figures

PROCESS AND APPARATUS FOR UNWINDING COILS OF WIRE

RELATED APPLICATION

This application is a continuation-in-part of pending patent application Ser. No. 451,950 filed Dec. 21, 1982 and entitled "Process and Apparatus for Easily Unwinding Coils of Wire Whatever the Original Mode of Wiring", which still is pending.

FIELD OF THE INVENTION

The present invention relates to a process and apparatus for unwinding coils of relatively rigid machine wire made of aluminum, copper or any other metal, such as, for example, rod wire. The coils are hollow, and unwinding commences from the center, withdrawing the inner turns first and proceeding progressively outward to completion by the withdrawal of the outermost turns.

BACKGROUND OF THE INVENTION

The problem at hand concerns the unwinding of coils of relatively rigid metallic wire easily, rapidly and without mishap for immediate use in machines which may take it with sudden stops and starts.

The wires in question are essentially, but not exclusively, made of non-ferrous metals, principally aluminum and copper. At present, those metals are continuously cast and rolled into wire at very high speed by the well known process of continuous casting and rolling on a wheel partially surrounded by a flat metal belt.

In order to wind such wire rapidly as it is manufactured, without the rhythm being slowed down, it frequently is necessary to abandon the conventional process of circular winding, by spooling about a horizontal axis supporting an expansible mandrel (FIGS. 1 and 2), and to replace it by a flat helicoidal winding about a vertical axis on a receiver (pallet or the like), with or without a central mandrel 1 or outer basket, which produces a winding in horizontal hypocycloidal layers (FIGS. 3, 4, 5 and 6).

Various forms of windings may be obtained depending on shape, length, eccentricity of the turns, speed of rotation of the tube forming the helix, distribution, the mean diameter and the thickness of the layers obtained by more or less slow, continuous or sequential rotation of the plate, the pallet or the receiver mandrel. The more or less thick layers of wire may be disposed flat in various ways, viz. as a spiral, rosette, etc. as shown in FIGS. 3, 4, 5 and 6. All such rapid flat windings have a much lower weight/volume ratio than do the circular windings wound by spooling on a horizontal mandrel (FIGS. 1 and 2).

It should be pointed out that the coils 2, 3 or 4 (FIGS. 1–6) of so-called machine wire constitute an intermediate stage between rolling and wire-drawing. When those two operations take place at the same site, the coils 3 or 4 are used as such. When the two sites are fairly remote from each other, it is necessary, in order to avoid excessive transport costs, to increase the weight/volume ratio by pressing the coils 3, 4 vertically so as to close up the turns which, due to their mode of manufacture, tend to form a spring. This operation may jam one or more badly placed turns and cause serious problems during unwinding. Because unwinding takes place by vertical traction on the wire starting from the center of the coil, there are risks of blockage, sudden winding off of several layers, formation of knots or breakage of wire. These mishaps may have serious consequences during wire-drawing or during the injection of aluminum wire into a ladle of molten steel for completing deoxidation.

This latter operation may be carried out with the aid of machines such as those described in French Pat. No. 2,112,093 dated Oct. 21, 1970, Pat. No. 2,184,456 dated May 15, 1972, Pat. No. 2,402,000 dated Sep. 2, 1977, Pat. No. 2,433,581 dated July 19, 1979 and Pat. No. 2,491,364 dated Oct. 3, 1980. These machines are designed mainly for flat elements, but they may use so-called machine wire, whatever the diameter thereof, depending upon the imperatives of price and the adjustment of speed for a predetermined rate in kg/min.

In order to avoid any sudden stoppage and subsequent mishaps, it is indispensable to be able to obtain satisfactory unwinding of the wire coil. At the present time, it appears that only the rosette-like helicoidal winding on a metal mandrel 1 (FIGS. 5 and 6) ensures satisfactory unwinding.

But such process requires considerable investment in special machinery, metal support mandrels and manpower. The cumbersome coils, having a fairly low weight/volume ratio (and hence considerable transport costs), generally are obtained from either a normal coil 2 (FIGS. 1 and 2) obtained by circular winding and spooling, or from coils obtained by helicoidal winding without a mandrel. They are then re-wound in rosette form, the wire being drawn from one and distributed on the second by means of a train of drive-presser rollers similar to that described in the above-mentioned French patents. This is an illogical and relatively expensive operation.

It is possible to unwind one or more wire coils 2, weighing one to two tons and obtained by normal winding, i.e. by spooled circular winding on horizontal axis. To unwind, the inverse operation must be carried out on a support with a horizontal reel, drawing the wire from the outside (FIGS. 7 and 8). The drawback of such method is the phenomenon of inertia arising from the weight and diameter of the wire coil and the speed of unwinding, and which increases as those parameters increase. It therefore is necessary to install on reel 5 (FIGS. 7 and 8) a brake 6 to be applied progressively or suddenly, in order to avoid the untimely unwinding of several turns and the risk of the formation of folds or knots in the wire. Such a reel is expensive and cumbersome. It often necessitates additional handling since the coils 2 frequently are delivered flat on pallets.

Tests heretofore made using a normally wound coil 2 (circular by spooling) placed on a fixed pallet 7 with its axis vertical (FIG. 9), by drawing the wire vertically from the center and causing it to pass over a guide drum 8, have not given encouraging results due to the incidence of simultaneous withdrawal of several turns which causes knots and blockage. Furthermore at the slightest incident, the final unwinding may experience a sudden collapse of the last five to ten windings, rendering them virtually unusable (FIG. 10). As a wound coil may comprise fifty to one hundred and twenty turns of a large diameter, depending on the height of the coil and the diameter of the wire, this frequent incident results in a considerable loss in weight, which is very expensive given the price of the metal.

It is the primary object of the present invention to unwind a coil of wire irrespective of its initial mode of winding, by means of a very simple apparatus without any mishap, by drawing the wire vertically from the center of the coil using the aforementioned patented machines.

In certain types of manufacture, for example wire-drawing, the rear end of the wire of one coil which is being unwound often is joined to the front end of a fresh coil. At the present time, this requires:

slowing down the reel supporting the coil being used stopping the machine during the joining operation starting up and accelerating the reel supporting the fresh coil.

This involves loss of time. Furthermore, the inertia of the coil and its reel limits the speed, and especially variations in speed, of the unwinding.

It is a further object of the invention to avoid these drawbacks.

The process and apparatus of the invention are applicable to coils 2 or 3 of wire of standard diameter ranging from 9.5 to 19.5 mm, with the coils placed with their axes vertical on a handling pallet 7.

SUMMARY OF THE INVENTION

The process forming the subject matter of the invention is characterized by the steps of:

(a) placing a hollow coil of wire flat on a plate with the axis of its central hole disposed vertically, (b) holding the coil stationary during the course of unwinding by gripping it externally with a rigid device, (c) drawing the wire upwardly from the central hole while causing the unwinding turns to increase their curvature slightly by sliding over a horizontal pressure device extending over the top of the coil and bearing downwardly thereon, (d) passing the wire through an eyelet maintained above the coil and (e) then passing the wire over a rotatable guide drum.

The apparatus of the invention for carrying out the process which has just been defined is characterized by:

(a) a horizontal plate for supporting a coil-holding pallet, (b) a main vertical upright firmly affixed to the plate adjacent an edge thereof, (c) an articulated corset element constituted of horizontal cross-pieces mounted pivotally on the main upright, the cross-pieces comprising articulatory sections having vertical uprights, (d) actuating means operative to close the corset element to grip the coil externally and secure it against movement during unwinding and to open the corset element sufficiently to permit the introduction of a fresh coil on the plate, (e) a horizontal pressure device extending over the coil and being adapted to press downwardly thereon, said pressure device being movable vertically to advance to and retract from the top of the coil, (f) actuating means located internally of the main upright for moving the pressure device vertically, said means having a stroke sufficient to retract the pressure device to enable placement of a coil-holding pallet on the plate and to advance the pressure device to press against the top of the coil, (g) a rotatable guide drum located above the coil and (h) a stationary eyelet disposed intermediate the top of the coil and the guide drum, (i) said eyelet and guide drum being operative to guide the wire as it is withdrawn from the coil.

The purpose of the apparatus is to unwind the wire from the coil. It is further characterized in that (a) the plate is fixed and sealed to the floor, (b) the main vertical upright is hollow and has a square cross-section, and is provided with hinges for supporting pivotally at least two vertically spaced horizontal cross-pieces constituting the articulated corset element, (c) the articulatory cross-pieces of the corset element are constituted of arcuate sections supporting articular uprights adapted to bear against and grip the coil, whereby the coil is held rigidly by at least three vertical uprights spaced apart angularly about the perimeter of the coil, (d) the horizontal pressure device may constitute either a roller or a fork provided with two parallel prongs, (e) the actuating means for moving the pressure device urges that device against the top of the coil under pressure sufficient to maintain the stability of the coil during unwinding, there being at least one vertical slot in the main vertical upright to provide clearance for the vertical movement of the pressure device, (f) a horizontal support for the stationary eyelet is affixed to the upper part of the main vertical upright and (g) the guide drum is provided with spaced lateral flanges.

According to the preferred embodiment, the main vertical upright is composed of two opposing, contiguous U-shaped bars or channels whereof the free edges are welded together. Preferably, also, the articulated corset element is tightened and locked rigidly about the exterior of the coil by any suitable securing means, such as bolts provided with spirally profiled cam elements, or hooks affixed to the end of springs, or by pneumatic jacks.

The invention may include a second apparatus of the type described above, the two apparatuses being located symmetrically with respect to a common and stationary main upright constructed and functioning as described heretofore.

Different combinations of the apparatus of the invention may be provided. For example, it may be combined with one or more identical apparatuses and be provided with one or more guide drums, whereby several coils may be unwound simultaneously and/or successively. Several juxtaposed apparatuses may be provided for unwinding an equal number of coils, the unwound wires passing over one guide drum only.

In another arrangement, a plurality of aligned apparatuses of the invention may be provided having a single eyelet of oblong or elongated shaped disposed in a direction parallel to the plane of the axes of the aligned coils. By providing a suitable wire connector between adjacent apparatuses, continuous unwinding of wire can be carried out without stoppage upon depletion of a coil. This is achieved by joining the end of the wire of one coil to the beginning of the wire of the following coil, by welding or the like, it being understood that unwinding always begins by unwinding the innermost turns and proceeds outwardly to completion with the unwinding of the outermost turns.

Advantages and Industrial Result

The user firstly has the free choice of selecting (1) the profile and section of the metal wire, (2) the mode of winding the coil and (3) the weight and number of coils in use.

He is totally free to use wire made of aluminum or any other metal under optimum technical and economic conditions depending on the installations at his disposal.

This process complements the machinery of the French patents mentioned above. It also may be used for facilitating unwinding of the coils during a wire-drawing operation, whereby the wire is passed through a succession of dies in order to reduce its original diameter so as to be able to place on the market wires, cables or other products of aluminum, copper, steel, etc. which may be used directly by the final consumer (industrial or private).

The apparatus of the invention makes it possible to increase the efficiency of machines for injecting aluminum wire into molten metal. A large reserve supply thus is obtained, and supply of a standard product is obtainable at the best price. Handling is reduced since the raw product can be used without intermediate modification. The mechanism does not require any energy consumption. Manpower is reduced. Storage in a restricted area on the worksite is safely ensured.

Manufacture of wires of 9.5 or 12.5 mm diameter is very widespread and is therefore subject to serious commercial competition.

The process and the apparatus of the invention also avoid all the drawbacks and mishaps mentioned at the beginning of this specification, particularly the occurrence of knots and blockages in the wire and the resulting loss of metal.

Apparatus with multiple plates allows storage of a large quantity of metal ensuring ample supply for the user devices and reducing the frequency of re-supply.

By using multiple apparatus with a wire connector, stoppages in unwinding are eliminated, this being particularly appreciated in certain manufacturing processes, particularly in wire-drawing.

BRIEF DESCRIPTION OF THE DRAWINGS

The invention will be more readily understood from the following description with reference to the accompanying drawings, in which.

DESCRIPTION OF THE SEVERAL EMBODIMENTS

Figure 1:
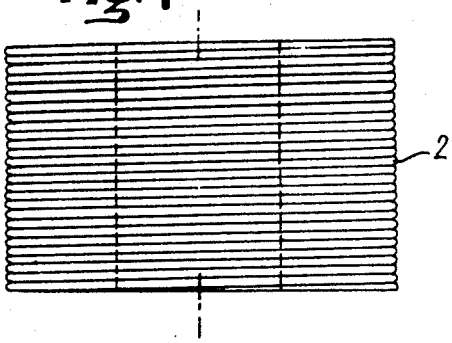
PRIOR ART Fig. 1
FIG. 1 is a view in elevation of a coil of wire wound in a circular manner by spooling, said coil being placed with its axis vertical.
Figure 3:
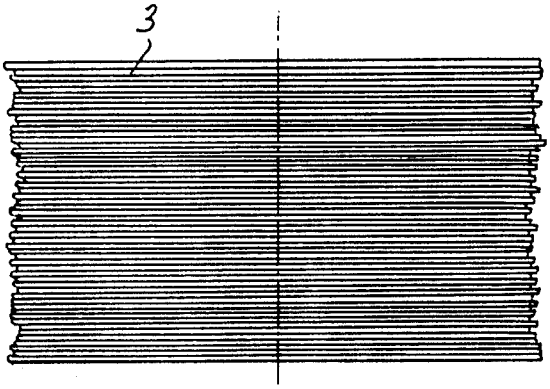
PRIOR ART Fig. 3
FIG. 3 is a view in elevation of a coil of wire wound helicoidally about vertical axes in horizontal hypocycloidal layers in spiral form without a central mandrel.
Figure 2:
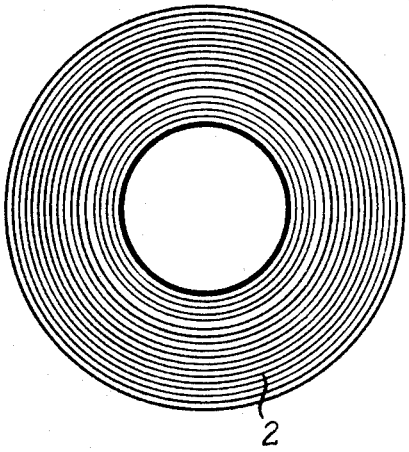
PRIOR ART Fig. 2
FIG. 2 is a plan view of the coil of FIG. 1.
Figure 4:
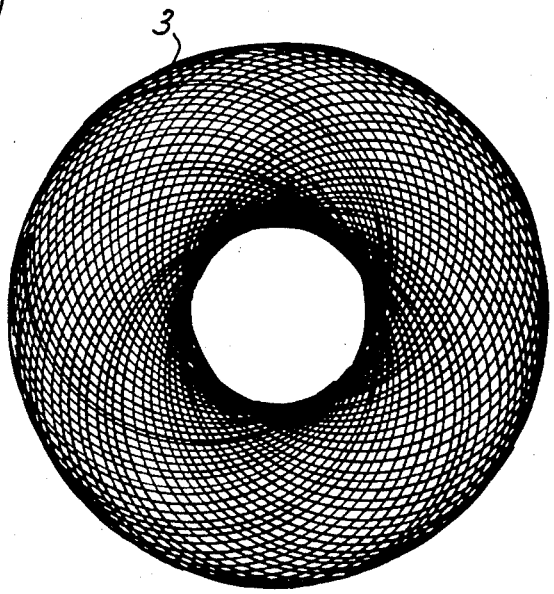
PRIOR ART Fig. 4
FIG. 4 is a plan view of the coil of FIG. 3.
Figure 5:
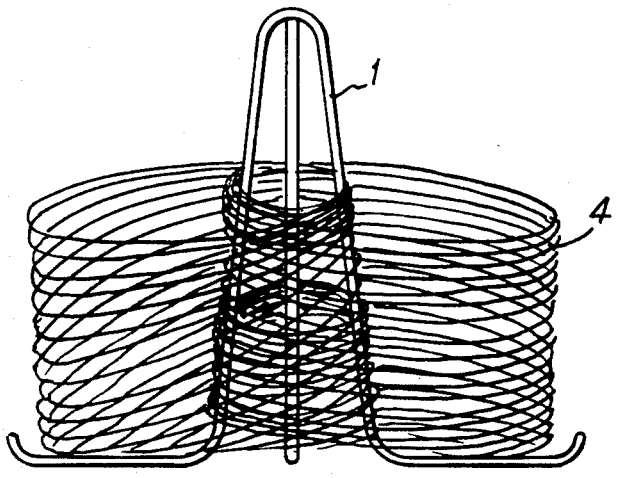
PRIOR ART Fig. 5
FIG. 5 is a view in elevation of a coil of wire wound helicoidally about a central mandrel extending vertically upward from radial supports having outer hooked ends, said winding being composed of horizontal hypocycloidal layers.
Figure 6:
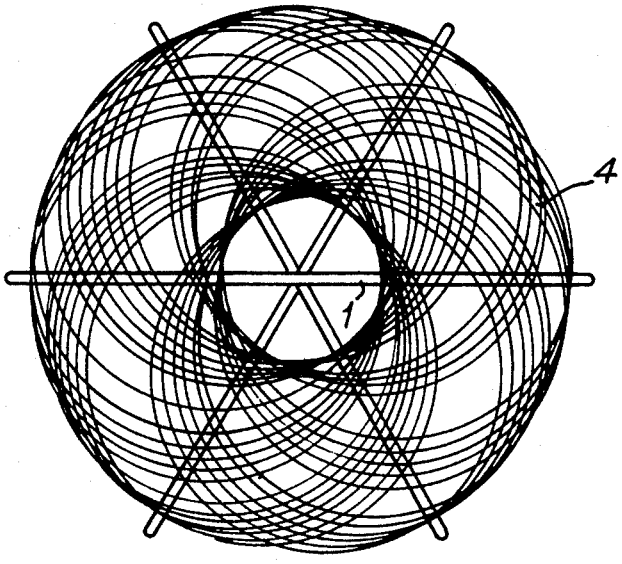
PRIOR ART Fig. 6
FIG. 6 is a plan view of the coil of FIG. 5.
Figure 7:
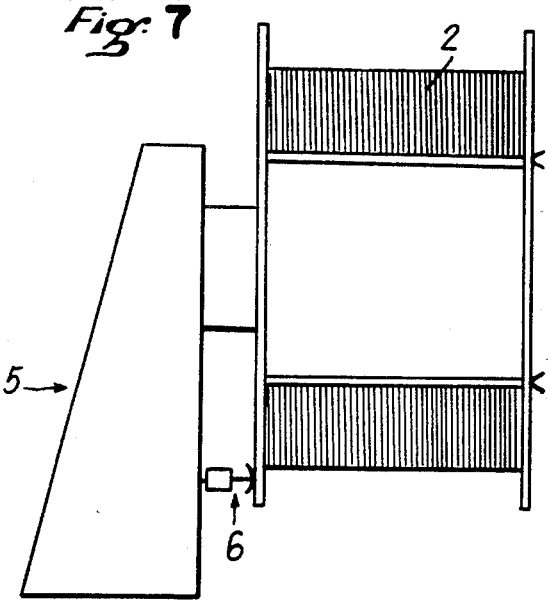
PRIOR ART Fig. 7
FIG. 7 is a schematic view in front elevation of an unwind support reel for a coil of wire wound circularly by spooling.
Figure 8:
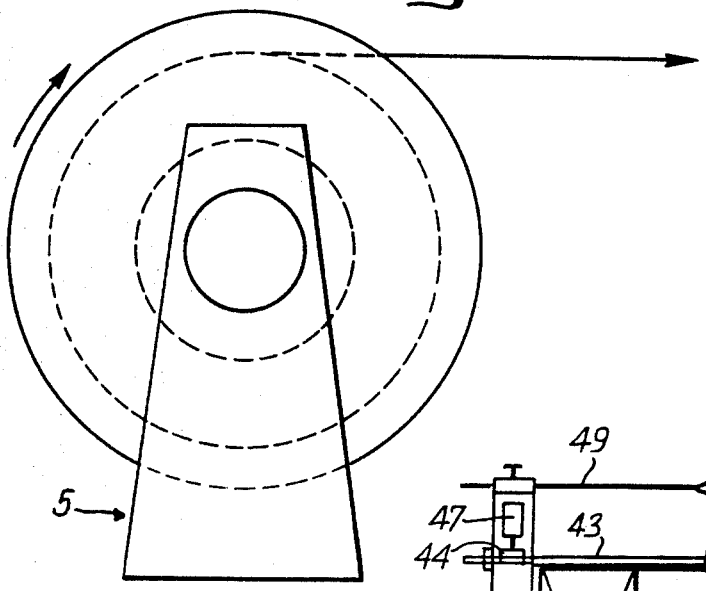
PRIOR ART Fig. 8
FIG. 8 is a side view of the support reel and coil of wire shown in FIG. 7.
Figure 11:
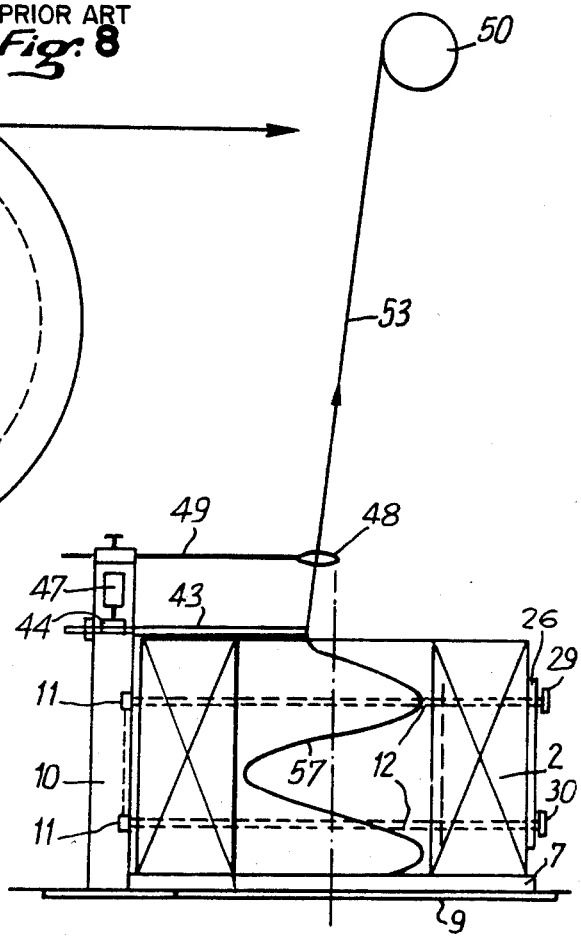
FIG. 11 is a schematic view in side elevation of a preferred embodiment of the invention, with a coil of wire in the course of being unwound.
Figure 9:
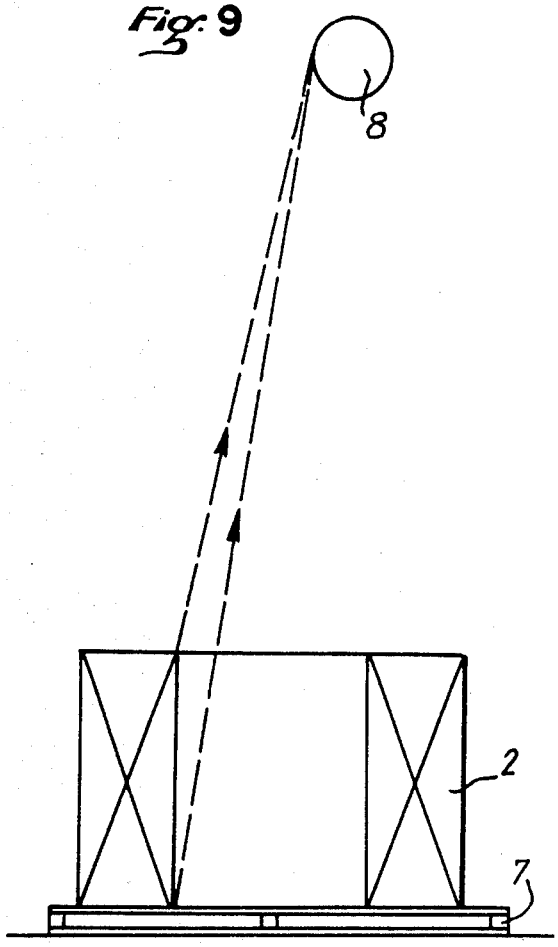
PRIOR ART Fig. 9
FIG. 9 is a schematic view in elevation of an installation for unwinding, from its center, a coil of wire wound in a circular manner by spooling.
Figure 10:
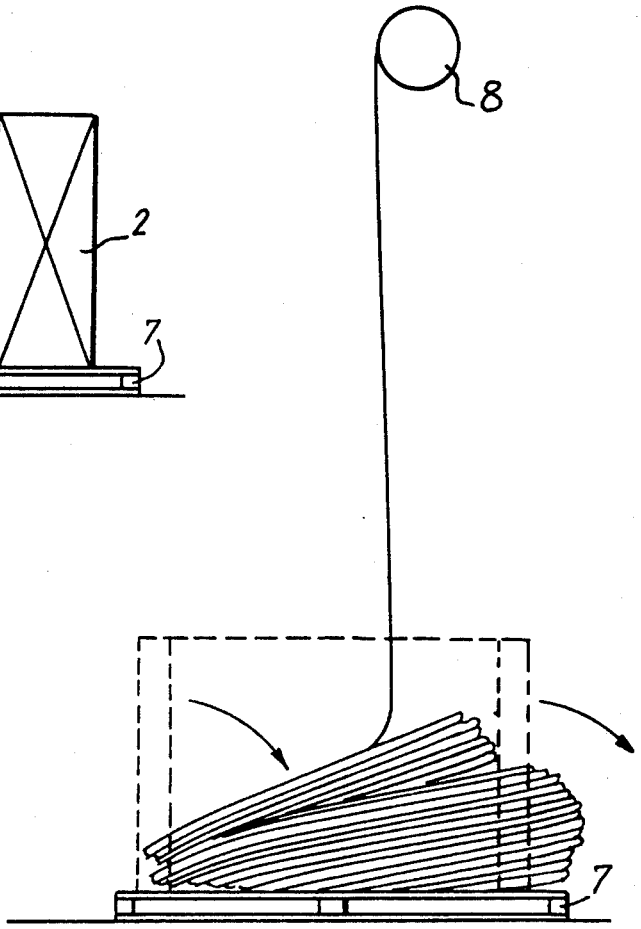
PRIOR ART Fig. 10
FIG. 10 is a view similar to that of FIG. 9 illustrating the collapse of the last several windings of the coil at the end of unwinding.
Figure 12:
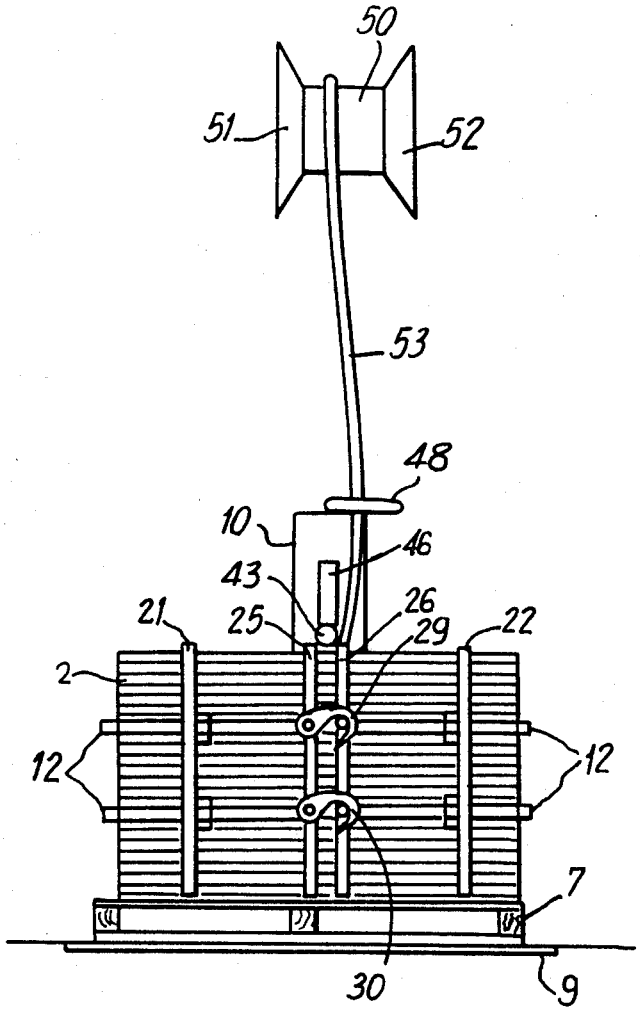
FIG. 12 is a view in front elevation of the embodiment of the invention shown in FIG. 11.
Figure 13:
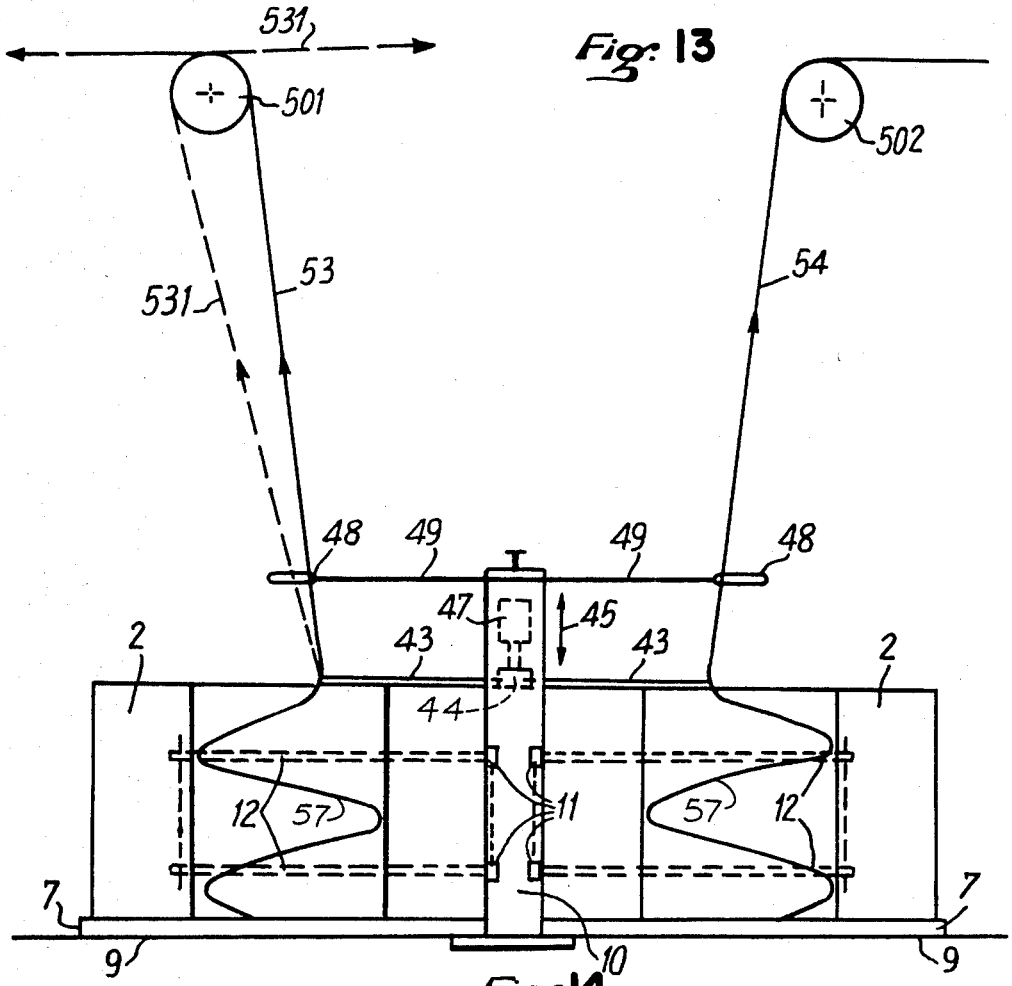
FIG. 13 is a schematic view in elevation of a second embodiment of the invention, with two coils in the course of being unwound.
Figure 14:
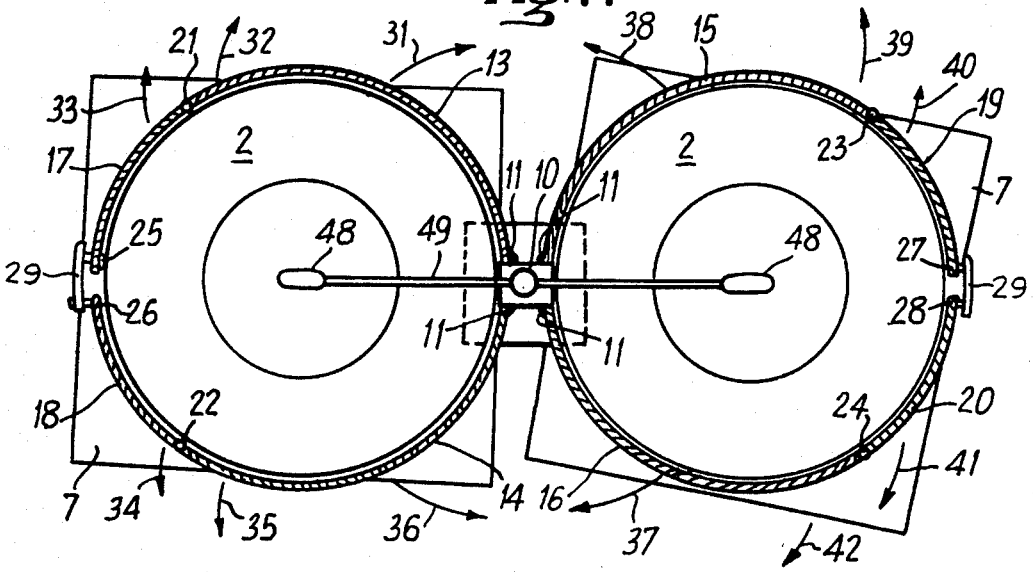
FIG. 14 is a plan view of the embodiment shown in FIG. 13.

Referring now to the drawings, FIGS. 11 and 12 show a single apparatus adapted to support only one coil 2 of wire, while FIGS. 13 and 14 show a double apparatus adapted to support two wire coils 2. In each case, the apparatus according to the invention includes a horizontal plate 9 on which is placed a pallet 7 for support of a coil 2 of wire disposed with its axis vertical. The apparatus also includes a stationary vertical main upright 10 affixed firmly on the plate 9, preferably by welding, adjacent one edge thereof. The fixed upright 10 is hollow, and has a generally square cross-section composed of two opposing U-shaped bars whose contiguous edges are welded together.

Mounted pivotally by means of hinges 11 on the main upright 10 are the arcuate components of a pair of horizontal, vertically spaced cross-pieces 12 forming an articulated corset element for gripping externally and holding securely the coil 2 during its unwinding. Each arcuate component of the vertically spaced cross-pieces 12 is articulated into separate sections connected by vertical uprights which function as joints.

More specifically, as illustrated by the apparatus shown in the left-hand portion of FIG. 14, the cross-pieces 12 may be constituted of articulated sections 13, 17 and 14, 18 connected, respectively, by articular or hinge-like vertical uprights 21 and 22. The distal ends of the cross-pieces 12 curve inwardly, and support spaced vertical uprights 25, 26 (FIGS. 12, 14) which are disposed in close proximity to each other when the wire coil 2 is firmly gripped by the corset element during unwinding. Pivotal clamps 29, 30 in the form of spirally profiled cams connect the spaced distal ends of the arcuate components of the cross-pieces 12 to secure the corset element tightly and rigidly around the exterior of the wire coil 2. The bolts 29, 30 are well known devices, and may be replaced by equivalent locking devices, such as spring and hook devices.

The arcuate sections 13 and 14 of the cross-pieces 12 are partially cylindrical, and each envelops about one-third of the perimeter of the coil 2. The uprights 21, 22 are designed to bear against the perimeter of the coil and assist in gripping it during unwinding. As has been explained, uprights 21, 22 also function as hinges for the arcuate end sections 17, 18 of the cross-pieces 12. Sections 17, 18 also are partially cylindrical in form, and each envelops approximately one-sixth of the perimeter of the coil 2.

By reason of the articulated structure of the cross-pieces 12 constituting the corset element, the wire coil 2 is clamped against the main upright 10 and is firmly held against rotation during unwinding. This is an especially important feature of the invention. Since the coil 2 does not rotate during unwinding, there is no problem of inertia, and "whipping" of the wire is eliminated during uncoiling. As a result, the speed of the wire drawing can be increased significantly.

After the coil 2 is totally unwound, the clamps 29, 30 are released and the arcuate components of the vertically spaced, articulated cross-pieces 12 are opened by suitable actuating means, as indicated by the directional arrows 31–36 in FIG. 14. The empty pallet 7 then is removed and a new wire coil 2, lying on its own pallet 7, may be installed. This maneuver usually is carried out with the aid of a fork lift truck.

Figure 17:
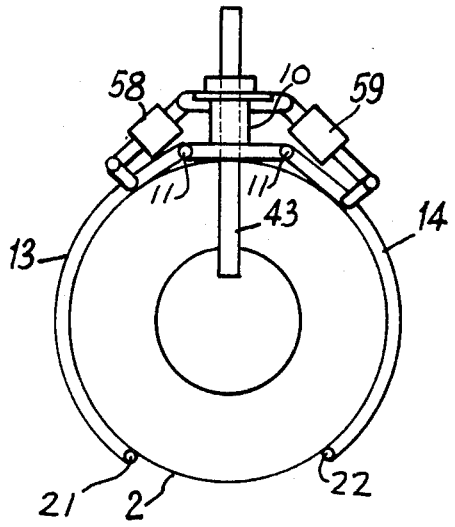
FIG. 17 is a plan view of a modification of the apparatus shown in FIGS. 11–16 utilizing pneumatic jacks.

FIG. 17 illustrates a preferred arrangement for opening and closing the cross-pieces 12 of the corset element using pneumatic jacks 58, 59 mounted on the main upright 10. In the modification shown in FIG. 17, the cross-pieces 12 are constituted only of sections 13, 14 and uprights 21, 22, and hence they do not completely surround the coil 2.

Another important feature of the apparatus of the invention resides in the horizontal pressure device 43, which may assume the form of a rotatable roller disposed radially with respect to the coil 2. The proximal end of the roller 43 is secured rigidly to a slide 44 (FIG. 11) adapted to move up and down vertically within the hollow main upright 10. Vertical displacement of the roller 43, as indicated by the directional arrow 45 in FIG. 13, is rendered possible due to vertical slots 46 (FIG. 12) formed in the upright 10. Vertical movement of the roller 43 is controlled by suitable actuating means such as a pneumatic jack 47 (FIGS. 11, 13) disposed inside the upper portion of the upright 10. The jack 47 is operative to raise pressure roller 43 when a coil 2 is being placed in position on plate 9 for unwinding, and is operative to lower that roller after the coil is in place.

The horizontal pressure roller 43 preferably is cylindrical, is rotatable on ball bearings (not shown) and may have a working length slightly less (on the order of 100 to 150 mm) than the outer radius of the coil 2. Since the radius of the coil may vary, roller 43 is elongated sufficiently to be adjustable axially relative to its slide support 44, and may be locked thereto in any selected position preparatory to use.

After the new coil 2 has been properly located on plate 9, and is securely clamped by the now rigid corset element constituted of the articulated cross-pieces 12, jack 47 lowers the pressure roller 43 against the top of the coil. It maintains roller 43 in contact with the coil under sufficient pressure to stabilize the coil during unwinding. The vertical stroke of the roller 43, under the influence of the jack 47, may be on the order of ten centimeters. However, if desired, the stroke of the jack 47 may be increased so as to be at least equal to the height of the coil 2, plus an extra distance sufficient to facilitate the ready and quick placement of a coil on plate 9.

Disposed above the pressure roller 43 is a horizontal eyelet 48 located at the distal end of a horizontal support 49 affixed to the upper portion of the main upright 10. Preferably, the eyelet 48 is located at least one meter above the coil 2, and is disposed within or closely proximate to the path of the vertical axis of the coil.

Located several meters above the eyelet 48 is a rotatable guide drum 50 for directing the wire 53 drawn from coil 2. Drum 50 is rotatable about a horizontal axis, and is provided with spaced flanges 51, 52.

The apparatus shown in FIGS. 11 and 12 functions as follows: The horizontal plate 9 is secured by any suitable means at a site chosen as being the most apt for supplying a machine for injecting or drawing metallic wire (copper, aluminum, steel, etc. . . .) most simply and economically. The site always is located at a level lower than that of the machine to be supplied with wire. Usually, the greater the difference in level between the eyelet 48 and the drum 50, the better the system operates. The apparatus having been located at the desired site, a hollow two-ton coil 2 of wire wound, for example, by spooling, which is the most simple and therefore the least expensive mode of winding, is placed on the horizontal plate 9 adjacent the main upright 10 and clamped by the corset element. The pressure roller 43 is lowered by the jack 47 and pressed against the upper face of the coil 2 to hold its turns firmly when an upward pulling force is exerted on the wire 53. The wire is unwound by drawing it upwardly from its hollow or central hole, each turn 57 (FIG. 11) passing successively over and/or along the surface of the roller 43 toward the central axis of the coil 2 before advancing upwardly through the eyelet 48 to the guide drum 50.

The pressure roller 43 causes the turns 57 of the wire 53 to increase their curvature slightly during unwinding. Also, the pulling force exerted by the advancing wire 53 on the roller 43 enables the unwinding forces acting on the coil to be decreased, by reducing the angle of attack of the wire on the inner circular wall of the spooled turns of wire. Thus, pressure roller 43 not only stabilizes the coil during unwinding, but it also functions to avoid the occurrence of jammed turns and the formation of blockages or knots in the wire. The radially extending roller 43, in combination with the rigid vertical support provided by the angularly spaced uprights 10, 21 and 22 located at approximately 120° intervals about the coil 2, ensures that the coil may be unwound completely through its terminal windings without mishap. The eyelet 48 further ensures correct unwinding of each coil 2, irrespective of whether its initial winding is right-handed or left-handed.

The two unwinding apparatuses illustrated in the double apparatus embodiment of FIGS. 13 and 14 are identical in structure, and are disposed symmetrically on opposite sides of a single main upright 10. The second apparatus shown to the right of the common upright 10 also includes an articulated corset element comprising a pair of vertically spaced cross-pieces 12 divided into two articulatory components for tightly gripping a wire coil 2. One such component is constituted of sections 15, 19 connected by an articular upright 23, and the other component is constituted of sections 16, 20 connected by an articular upright 24. Secured to the distal ends of the sections 19, 20, respectively, of the cross-pieces 12 of the second apparatus are vertical uprights 27, 28. A vertically spaced pair of clamps 29, 30 are operative to lock coil 2 securely within the enclosure means constituted of the main upright 10 and the now rigid corset element composed of the articulated cross-pieces 12. The sections 15, 16, 19, 20 of the second apparatus also are arcuate, and their uprights 23, 24 also function as hinges. The arcuate sections 15, 16 each envelop about one-third of the perimeter of the coil 2, while the sections 19, 20 each overlap about one-sixth of the perimeter of the coil. The directional arrows 37–42 indicate the manner of the opening of the sections 15, 16, 19, 20 of the corset element of the second apparatus following unwinding.

Both of the apparatuses illustrated in FIGS. 13 and 14 include pressure rollers 43 and eyelets 48. The articulatory cross-pieces 12 of the two apparatuses illustrated in these Figures are connected pivotally to the single main upright 10 by hinges 11. Guide rolls 501 and 502 are provided for the advancing wires 53 and 54, respectively. The solid line path for wire 53 indicates that it may be withdrawn in a direction opposite to that in which wire 54 is withdrawn. However, as indicated by the dashed line 531, wire 53 may be withdrawn over guide drum 501 so as to pass in the same direction as wire 54.

The embodiment illustrated in FIGS. 13 and 14 is loaded with wire coils 2 in the same manner that the apparatus of FIGS. 11 and 12 is loaded. A separate two-ton wire coil 2 may be placed on opposite sides of the common upright 10, thereby providing four tons of wire to be unwound by the two apparatuses. The unwinding of the two coils illustrated in FIGS. 13 and 14, utilizing pressure rollers 43, eyelets 48 and guide drums 501 and 502, is carried out simultaneously, correctly and without mishap, in the same manner, as that described in respect of the embodiment of FIGS. 11 and 12.

Figure 15:
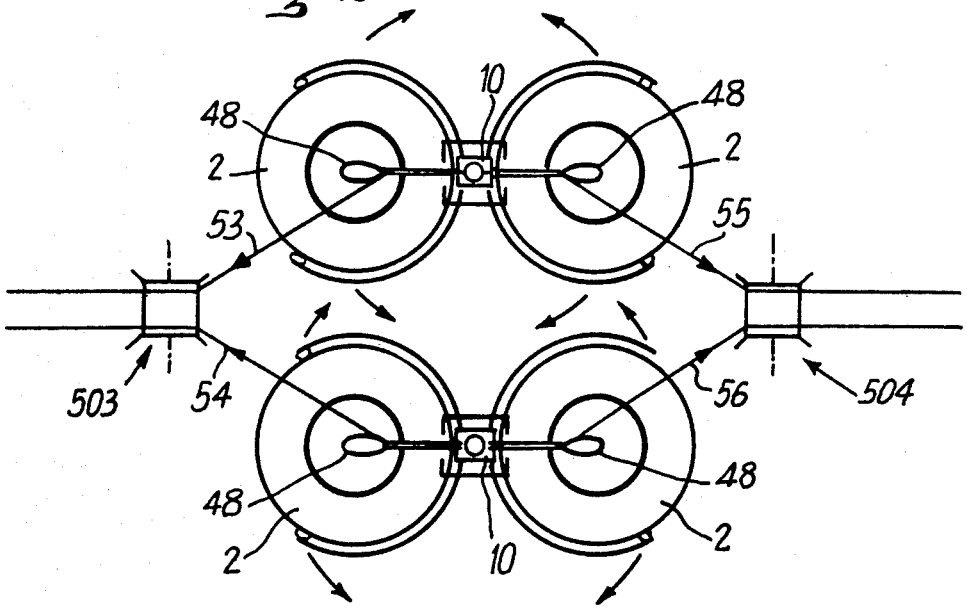
FIG. 15 is a schematic view in plan of a third embodiment of the invention, with four coils disposed in a square in the course of being unwound.

FIG. 15 shows an arrangement of two double apparatuses of the type illustrated in FIGS. 13 and 14, disposed side by side so that the four coils 2 form a square. This arrangement includes two wire guide drums 503, 504 which direct the wires 53, 54 on the one hand, and wires 55, 56 on the other hand, in two different directions. In the same manner as illustrated in FIG. 13, a rearrangement of the wires 53–56 may be envisioned to direct all of them in the same direction.

Figure 16:
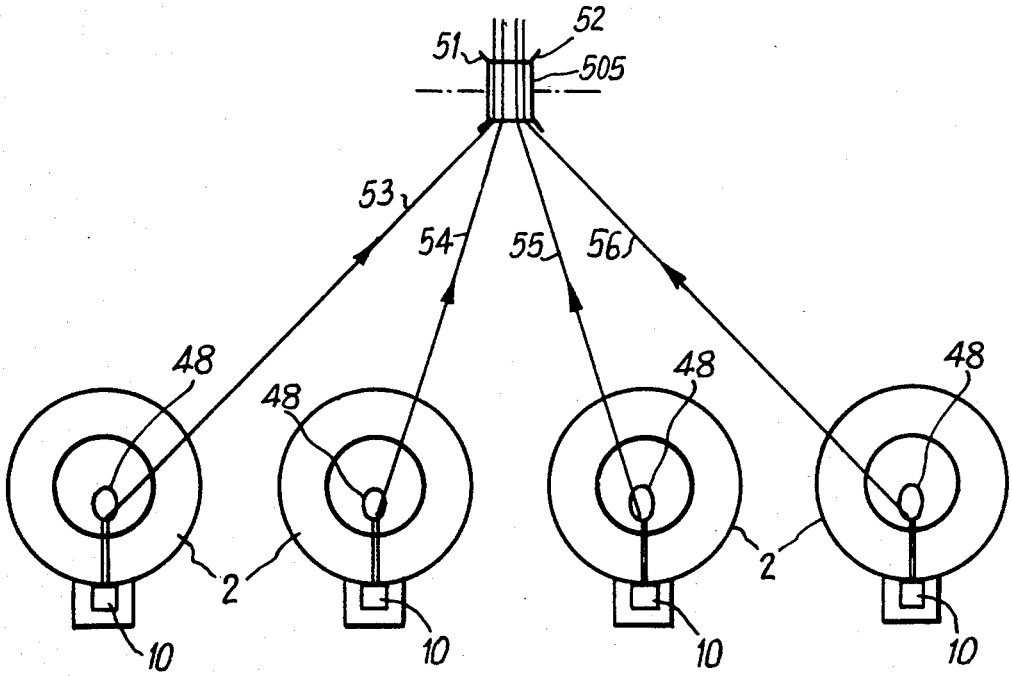
FIG. 16 is a schematic view in plan of a fourth embodiment of the invention, with four aligned coils in the course of being unwound.

FIG. 16 shows a different embodiment comprising four apparatuses of the type illustrated in FIGS. 11 and 12 disposed side by side in a line, so that all of the wires 53–56 pass over one guide drum 505, which directs them in the same direction.

Many other arrangements of the apparatus of the invention may be envisioned without departing from the scope thereof.

Figure 18:
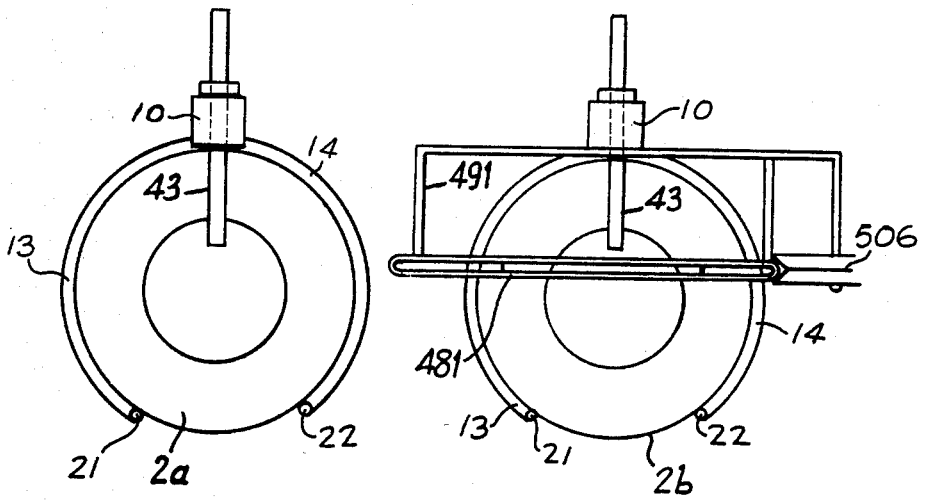
FIG. 18 is a schematic view in plan of a fifth embodiment of the invention, having a common oblong eyelet permitting two wire coils to be connected end to end in the course of unwinding.
Figure 19:
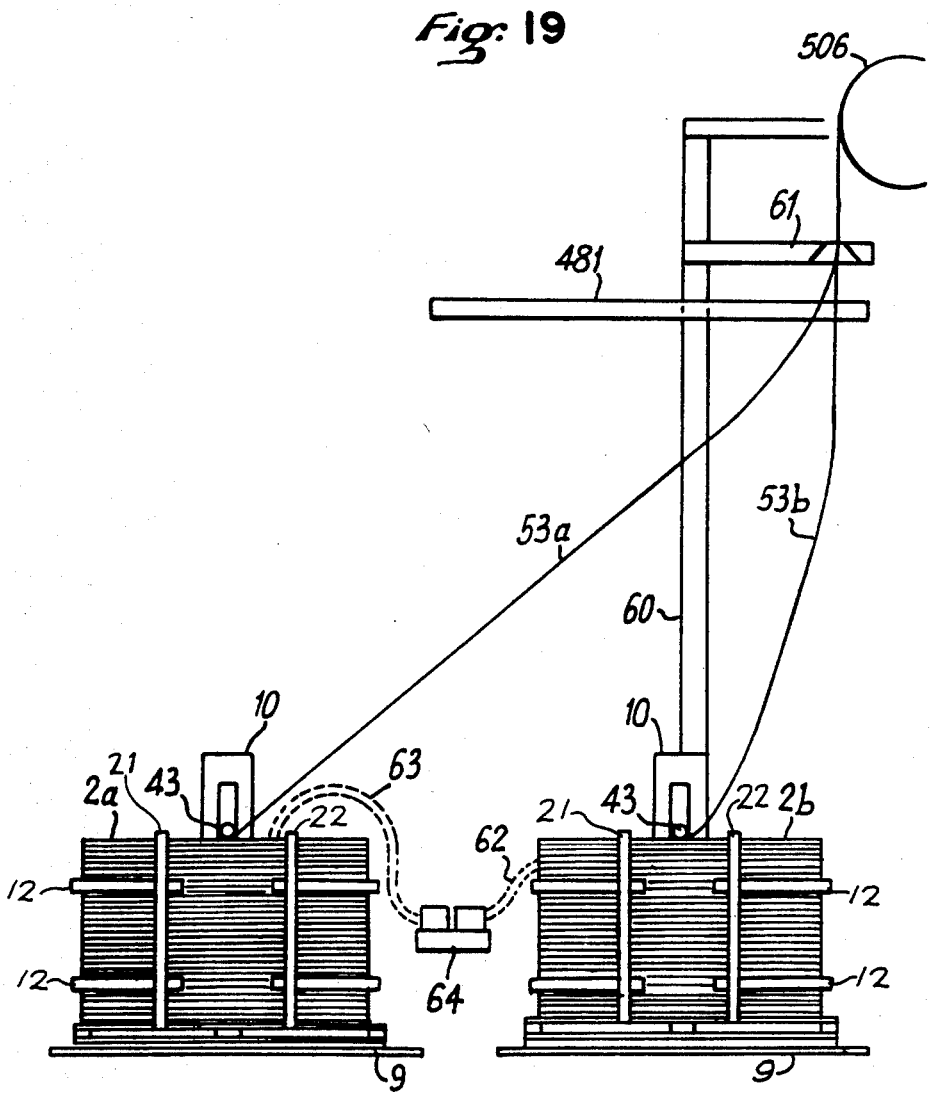
FIG. 19 is a fragmentary view in front elevation of the embodiment shown in FIG. 18.

The embodiment of the invention shown in FIGS. 18 and 19 illustrates apparatus where continuous coil unwinding is necessary, as in the case of wire-drawing. It includes at least two horizontal plates 9 arranged side by side to support, respectively, the wire coils 2*a* and 2*b*. Affixed to each of the plates 9 is a separate stationary upright 10 supporting separate horizontal pressure rollers 43.

The embodiment in FIGS. 18 and 19 includes only one oblong or elongated horizontal eyelet 481 through which may pass both of the wires 53*a* and 53*b* unwound from the coils 2*a*, 2*b*, respectively, en route to the common wire guide roller 506. The common elongated eyelet 481 is supported above the coils 2*a*, 2*b* by a vertical bracket 60 and a horizontal support 491. The eyelet 481 advantageously may be constituted of two parallel rollers. A funnel-shaped wire guide 61 is interposed between the elongated eyelet 481 and the drum 506.

In order to join the outer end 62 (FIG. 19) of the wire of coil 2*b* to the inner end 63 of the wire of coil 2*a*, a connector 64 is provided which makes an electrical weld by resistance or flash welding to join the wire ends 62, 63 together.

The apparatus of FIGS. 18 and 19 functions as follows: If it is assumed that the coil 2*b* is in the course of being unwound, and that the coil 2*a* is in position on the adjacent plate 9, the strand 53*b* will pass through the oblong eyelet 481 and the guide 61 to the drum 506. During this time, the outer end 62 of the coil 2*b* and the inner end 63 of the coil 2*a* are manipulated in order to be joined together in the connector 64 by flash welding or the like. Thereupon, the now joined ends 62, 63 are removed from the connector 64 so that, when the coil 2*b* is completely unwound, withdrawal of wire continues without interruption by the unwinding and withdrawal of wire 53*a* from the interior of the coil 2*a*.

Meanwhile, a replacement coil may be brought to the site where coil 2*b* had been located. The inner strand end of this new coil then is placed in the connector 64 to weld it to the outer strand end of coil 2*a*. The inner and outer ends of the two coils are arranged always to pass above the arcuate sections of the cross-pieces 12 constituting the articulated corset element for gripping and holding the coils 2*a* and 2*b*. In this manner, wire unwinding is continuous without any stoppage.

Figure 20:
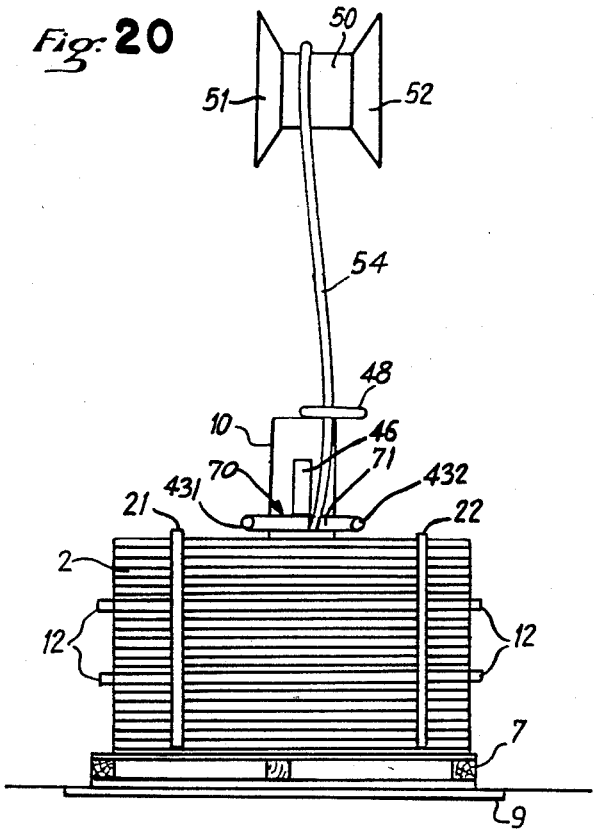
FIGS. 20–24 inclusive illustrate a further modification of the apparatus of the invention, FIGS. 20 to 23 corresponding, respectively, to FIGS. 12 to 14 and 17, and FIG. 24 corresponding to the apparatus illustrated in the left-hand portion of FIG. 18.
Figure 24:
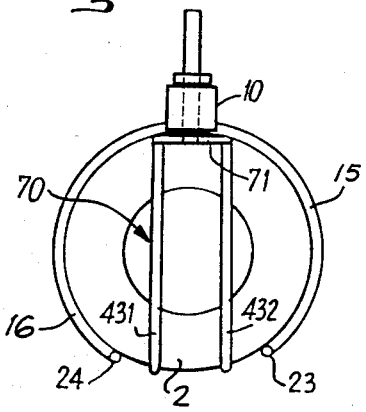
Figure 21:
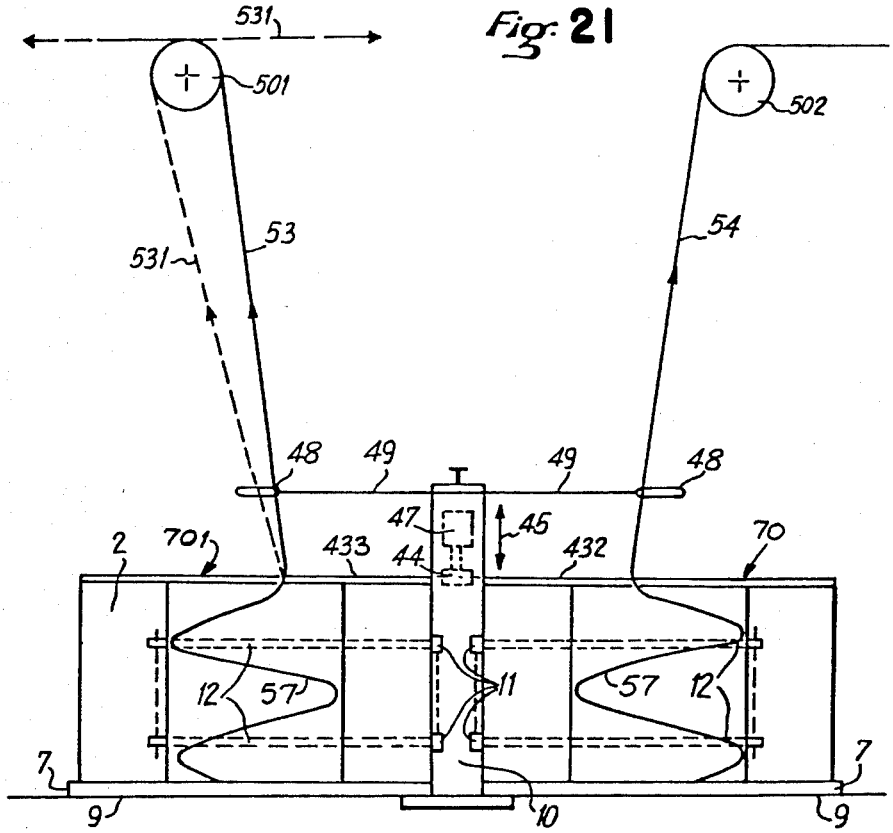

FIGS. 20–24 illustrate an important modification of the invention, by the replacement of the rotatable pressure rollers 43 with horizontal forks provided with two spaced and generally parallel prongs. Referring specifically to FIGS. 20 and 24, there is illustrated a horizontal pressure fork 70 composed of a pair of spaced, parallel prongs 431, 432 connected at their proximal ends by a horizontal crossbar 71 which, in turn, is affixed to the vertically movable slide 44 (FIGS. 11, 21). The two rectilinear prongs 431, 432 and their connecting crossbar 71 preferably are cylindrical or tubular in cross-section. The prongs 431, 432 are disposed symmetrically relative to the vertical axis of the coil, and extend completely across the top of the coil. Preferably, the distance between the horizontal prongs 431, 432 is substantially equal to the original inner radius of the coil 2.

Under the influence of the jack 47 (FIGS. 11, 21), the prongs 431, 432 are urged constantly into contact with the upper spirals of the coil 2 so as to stabilize the coil during unwinding. Preferably, the prongs 431, 432 have a length at least equal to the outer diameter of the coil, whereby the prongs are enabled to extend to and bear downwardly against the portion of the coil spaced diametrically from the main vertical upright 10. The double-pronged arrangement of the pressure fork 70 enables one prong to hold a half portion of a wire spiral being unwound while the other half of the same spiral unwinds and slides along the second prong, and vice versa.

Figure 23:
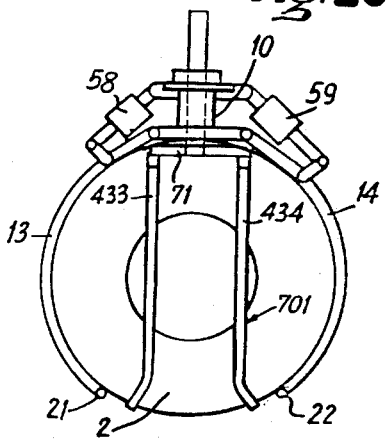
Figure 22:
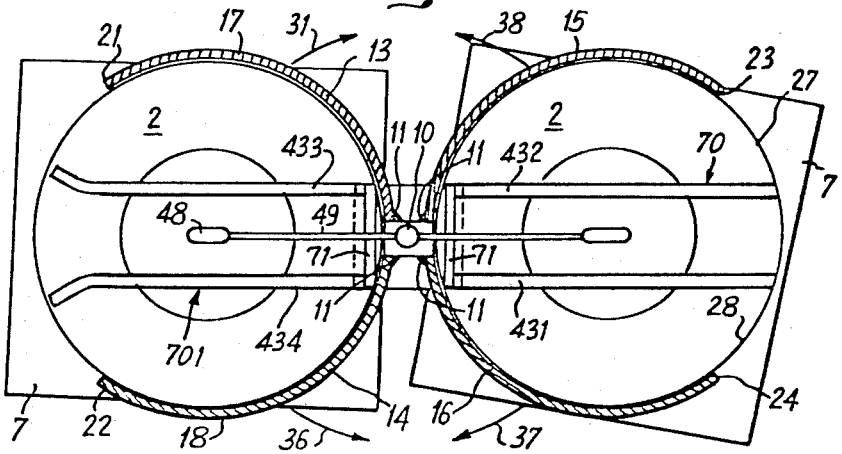

The elongated prongs of the pressure fork may have their distal ends outwardly curved or divergent, as illustrated by the prongs 433, 434 of the horizontal pressure fork 701 shown in FIG. 23, and also as shown in the left-hand portion of FIG. 22. Similarly to fork 70, the proximal ends of the spaced prongs 433, 434 of the pressure fork 701 are connected by crossbar 71 which, in turn, is secured to the vertically displaceable slide 44. The curved configuration of the horizontally diverging distal ends of the prongs 433, 434 facilitates the passage of the unwinding turns 57 toward the center of the coil, as the wire is unwound and advances toward the stationary eyelet 48 and the rotatable guide drums 50, 501 or 502.

Preferably, in the modifications of FIGS. 20–24, the vertical stroke of the pressure jacks 47, for advancing the forks 70, 701 to the coils 2 and retracting them from the coils, is at least equal to the height of the coil plus a little extra so as to facilitate the replacement of fresh coils on the plates 9.

As will be observed, the vertically spaced, articulated cross-pieces 12 constituting the corset elements do not completely surround the coils 2 in FIGS. 20–24, in that the end sections 17, 18, 19, 20 and their vertical uprights 25, 26 (FIGS. 12–14) have been eliminated. This arrangement avoids the possibility that vertical movement of the prongs 431–434 of the forks 70, 701 may be hindered by the end sections of the cross-pieces 12. In all cases, however, the coils 2 are tightly retained against rotary movement during unwinding by the rigid clamping effect of the three arcuately spaced uprights 10, 21, 22 or 10, 23, 24 when the articulated corset elements are closed about the coils.

Whatever the object of the unwinding—injection ladeling, wire-drawing, etc.—the process and apparatus of this invention is applicable irrespective of the original manner of winding of the coil. Further, this invention may be applied to the unwinding of capillary wire, i.e. hollow wire, for example, of steel or aluminum shaped as a continuous, relatively supple tube inside of which has been incorporated a powder (silico-calcium or pulverulent magnesium, in particular) before the sheath-like tube is closed.

We claim:

1. Apparatus for winding hollow coils of wire by drawing wire upwardly from the central hole of a coil, characterized by (a) a plate for supporting a coil of wire with the axis of its central hole disposed vertically, (b) a main vertical upright firmly affixed to the plate, (c) an articulated corset element mounted pivotally on the main upright for holding the coil stationary during unwinding, said corset element being constituted of horizontal cross-pieces composed of articulatory sections and vertical uprights, (d) corset actuating means operative to close the corset element to grip the coil of wire externally during unwinding and to open the corset element sufficiently to permit the placement of a coil on the plate, (e) a pressure device extending over the coil and being operative to bear downwardly on the top of the coil to stabilize the coil during unwinding and (f) pressure device actuating means for moving the pressure device vertically, said pressure device actuating means being operative to advance the pressure device to press against the top of the coil and to retract the pressure device to enable placement of a coil on the plate.

2. The apparatus of claim 1, characterized by a pressure device having at least one elongated component of cylindrical external configuration.

3. The apparatus of claim 1, characterized by a pressure device comprising a horizontal rotatable pressure roller, the length of said pressure roller being slightly less than the outer radius of the coil.

4. The apparatus of claim 1, characterized by a pressure device comprising a horizontal pressure fork provided with spaced prongs disposed symmetrically relative to the vertical axis of the coil, each said prong having a length substantially equal to the outer diameter of the coil.

5. The apparatus of claim 4, characterized by prongs having diverging distal ends.

6. The apparatus of claim 4, characterized by the horizontal pressure fork having two substantially parallel prongs spaced apart by a distance approximately equal to the inner radius of the coil before unwinding, said prongs having distal ends curving outwardly relative to the vertical axis of the coil.

7. The apparatus of claim 1, characterized by (a) the main upright being hollow and located adjacent to an edge of the plate, (b) a vertical slot disposed in the main upright, (c) a vertically movable slide disposed internally of the main upright and connected through the slot to the pressure device and (d) a jack located internally of the main upright for moving the slide vertically, (e) said vertical slot being elongated to provide clearance for permitting vertical movement of the slide and the pressure device.

8. The apparatus of claim 1, characterized by (a) a rotatable guide drum located above the coil and (b) a stationary eyelet disposed intermediate the top of the coil and the guide drum, said eyelet being operative to direct wire withdrawn from the coil to the guide drum.

9. The apparatus of claim 1, characterized by (a) a corset element constituted of at least two vertically spaced articulated cross-pieces, (b) said cross-pieces comprising arcuate sections supporting the vertical uprights, (c) said vertical uprights together with the main vertical upright constituting at least three uprights spaced angularly about the perimeter of the coil and being operative to clamp the coil during unwinding.

10. The apparatus of claim 9, characterized by (a) each cross-piece having a plurality of articulated sections connected hingedly by articular vertical uprights, (b) said cross-pieces each including end sections having distal ends supporting vertical uprights, and (c) clamp means mounted on the distal ends of the end sections of the cross-pieces for locking the corset element rigidly about the perimeter of the coil.

11. The apparatus of claim 10, characterized by (a) each cross-piece having four articulated sections, two of said four sections comprising said end sections and two of said sections being intermediate sections interposed between the end sections and the main vertical upright on which the corset element is mounted pivotally, (b) said end sections each extending over approximately one-sixth of the perimeter of the coil and (c) said intermediate sections each extending over approximately one-third of the perimeter of the coil.

12. The apparatus of claim 10, characterized by clamp means composed of pivotal clamps provided with spirally profiled cam elements.

13. The apparatus of claim 1, characterized by a hollow main upright having a square cross-section and constituted by two opposing U-shaped bars having contiguous edges welded together to provide a unitary structure.

14. The apparatus of claim 1, characterized by pneumatic jacks mounted on the main vertical upright for closing and opening the corset element.

15. The apparatus of claim 1, characterized by (a) at least two of said apparatuses juxtaposed side by side, each said apparatus including the aforesaid plate for supporting a coil of wire with its axis vertical, main vertical upright, articulated corset element, corset actuating means, pressure device and pressure device actuating means, (b) at least one rotatable guide drum located above the apparatuses and (c) at least one stationary eyelet disposed intermediate the apparatuses and the guide drum.

16. The apparatus of claim 15, characterized by a common main vertical upright disposed between two adjacent apparatuses, said common upright supporting pivotally the articulated corset element of each apparatus.

17. The apparatus of claim 15, characterized by (a) four of said apparatuses disposed in proximity to each other, (b) a stationary eyelet disposed above each apparatus and (c) two guide drums located above the stationary eyelets, each drum being operative to guide two wires withdrawn from two separate coils of wire.

18. The apparatus of claim 15, characterized by (a) four of said appartuses disposed in a row, (b) a stationary eyelet disposed above each apparatus and (c) one guide drum located above the stationary eyelet for guiding wire withdrawn from four separate coils of wire.

19. The apparatus of claim 15, characterized by (a) two of said apparatuses disposed in proximity to each other, (b) an eyelet having an elongated configuration disposed above the apparatuses and (c) wire connection means disposed between said two apparatuses for joining together an end of the wire of a first coil to an end of the wire of a second coil whereby, when the first coil is completely unwound, unwinding of the second coil commences without interruption of unwinding 20. The apparatus of claim 19, characterized by wire connector means operative to weld the outer end of the wire of the first coil to the inner end of the wire of the second coil.

21. The apparatus of claim 19, characterized by a funnel-shaped wire guide interposed between the elongated eyelet and the guide drum.

* * * * *